United States Patent [19]

Wieczorek

[11] Patent Number: 4,931,705

[45] Date of Patent: Jun. 5, 1990

[54] CIRCUIT ARRANGEMENT FOR TEXTILE MACHINES, PARTICULARLY SPINNING MACHINES HAVING INDIVIDUALLY MOTOR-DRIVEN SPINDLES

[75] Inventor: Stefan Wieczorek, Fellbach, Fed. Rep. of Germany

[73] Assignee: SKF Textilmaschinen-Komponenten GmbH, Fed. Rep. of Germany

[21] Appl. No.: 234,136

[22] Filed: Aug. 19, 1988

[30] Foreign Application Priority Data

Aug. 21, 1987 [DE] Fed. Rep. of Germany ..... 3727939

[51] Int. Cl.[5] ..... H02P 7/67

[52] U.S. Cl. ..... 318/49; 318/50; 28/187

[58] Field of Search ..... 318/34, 49, 50, 67, 318/51, 60, 82, 105, 113; 439/207, 210; 28/185, 186, 187, 213

[56] References Cited

U.S. PATENT DOCUMENTS

| | | | |
|---|---|---|---|
| 587,937 | 8/1897 | Davis | 318/50 |
| 2,248,393 | 7/1941 | Schwarz | 318/49 |
| 3,447,050 | 5/1969 | Geis | 318/67 |
| 4,174,237 | 11/1979 | Hemming, Jr. et al. | 318/67 X |
| 4,288,726 | 9/1981 | Vazquez-Cuerro et al. | 318/34 X |
| 4,289,997 | 9/1981 | Jung et al. | 318/49 X |
| 4,562,388 | 12/1985 | Wolf | 318/49 X |

*Primary Examiner*—William M. Shoop, Jr.
*Assistant Examiner*—A. Jonathan Wysocki
*Attorney, Agent, or Firm*—Wigman & Cohen

[57] ABSTRACT

In a circuit arrangement for textile machines having a plurality of identical aggregates, each having a drive motor (1), particularly for spinning machines having individually driven spindles, respective motor bars are provided for the connection of each aggregated. Each motor bar is connected with a ground plate which is provided with energy supply lines and has a predetermined number of bar connectors. At least the energy supply lines of a minimum of two ground plates are connected with each other and with a connecting line (9) common to them which leads to a central energy supply device (2) of the machine.

12 Claims, 8 Drawing Sheets

U
1
0
24V
0V
t
TEMP. SENSOR
Temp. < 90°
Temp>90°
PUSH-BUTTON SWITCH
THREAD MONITOR
REL. 12
ON
OFF
REL. 13
T0
T1
T2
T3
T4
T5
T6
T7
T8
T9
T10
T11

CIRCUIT ARRANGEMENT FOR TEXTILE MACHINES, PARTICULARLY SPINNING MACHINES HAVING INDIVIDUALLY MOTOR-DRIVEN SPINDLES

BACKGROUND OF THE INVENTION

The invention relates to a circuit arrangement for textile machines having a plurality of identical aggregates with respective drive motors, and more particularly to spinning machines with individually motor-driven spindles. Aggregates are portions of thread spinning or twisting apparatus, generally including a spindle and a motor for driving the particular spindle.

Because textile machines of the above-described type can have a plurality, for example more than 500 drive motors, the electrical current supply requires a great number of conductors. Control lines are required in addition thereto. It is not just the expense for these lines and their placement in cable conduits that are disadvantageous, but also the completion of the many connections.

SUMMARY AND OBJECTS OF THE INVENTION

The primary object of the invention, therefore, is to create a circuit arrangement of the above-described type, with which the expense of the known arrangement can be reduced and which can still be employed universally.

Briefly described, the aforementioned object is accomplished according to the invention by providing a circuit arrangement for textile machines having a plurality of identical aggregates arranged adjacent to one another in a row and having individual drive motors, particularly for spinning machines with individually driven spindles and a row of motor bars that is parallel to this row, which motor bars are each spatially and functionally associated with respective aggregates. As used herein the term "motor bar"may be a plate of isolating or insulating material bearing or supporting the elements of the motor control and the plugs for connecting the motor control with the ground plate. The motor bars are arranged in groups on at least two ground plates in which the ground plates all extend parallel to the row formed by the motor bars and also form a row, the ground plates have a length in the direction of the row formed by the ground plates which corresponds to the spatial requirements of the group of motor bars carried thereby and to the associated group of aggregates in the direction of the row formed by the ground plates, the ground plates have energy supply conductors extending over their length with which bar connectors are connected, and at least the energy supply conductors of at least two adjacent ground plates are connected with each other and with a connecting line common to both of said at least two adjacent ground plates, which connecting line leads to a central energy supply device of the machines.

The construction of the circuit arrangement requires only that ground plates, the number of which depends on the number of individual aggregates, be provided and that they be equipped with the requisite number of motor bars. Accordingly, the circuit arrangement according to the invention can be used for all appropriate textile machines including ring spinning machines. Above all, the complete installation can easily be performed by the machine manufacturer, because aside from the equipping of the ground plates with the necessary motor bars, all that need be done is to make the connections between the aggregates and the motor bars, and between the common connector line and one of the ground plates, which are to be connected with each other. The installation is simplified even further in that the number of connecting lines running from the central energy supply to the ground plates is small, which, together with the use of ground plates and motor bars, contributes to the fact that the overall circuit arrangement can be housed in a relatively small cable conduit. Such a cable conduit may be of the protective type IP 54 (Deutsche Industrie Normen DIN 40050), whereby the entire circuit arrangement receives an equally high level of protection. In addition, a cable conduit of this type can also serve to shield the circuit arrangement.

The construction of the circuit arrangement out of ground plates and motor bars yields the additional advantage that the circuit arrangement can easily be adapted to different sizes of textile machines of the type under discussion. For example, a group consisting of several ground plates can be formed which, like the motor bars and the ground plates, offers the advantage that disruptions can be limited to as small a portion of the machine as possible, and the supply lines, brake switch relays and protective devices can be designed for smaller capacity. An additional significant advantage is that, when needed, the connection of the agqregate to the motor bars and the connection of the motor bars with their ground plates can easily he broken. This makes it possible to exchange motors, motor bars and ground plates simply, safely and quickly. Finally, the solution according to the invention also offers the possibility of automating the machine. The transfer of the signals and commands necessary for this purpose can be accomplished with a conducting system structured like that for the energy supply, so that the necessary connections, like those of the energy supply lines, can preferably be manufactured together with said energy supply lines, with appropriate plugs and connectors. But even if no automation is provided a control line system of this type can be advantageous, for example in fiber monitoring and/or determining and transmitting the actual value of the motor speed to the machine control.

The motor bars preferably are electrically connected with the associated ground plates by plug connectors and are mechanically connected therewith by snap connectors, in order to make it possible to make the connections and disconnect them in the simplest possible manner.

The ground plates are preferably also formed as bars that carry conductors on their rear side opposite the motor bars, which conductors form the energy supply lines and, if provided, the signal transfer lines. The number and length of the cables to be laid are by this means reduced to a minimum. In addition, the plug connector elements necessary for the connection of the motor bars can easily be connected with their associated conductors. It is particularly effective when the conductors extend in a straight line in the longitudinal direction of the ground plates, because then the connections can be manufactured in the same manner for all of the motor bars. The motor bars are namely arranged in a row adjacent to one another on the associated ground plate, because as a rule the aggregates of the machine are also arranged adjacent to each other in a row. The connections between the conductors of the individual ground plates can be produced in an especially simple and space-saving manner when the connection points necessary therefor are arranged at the two ends of the ground plates.

The motor bars carry all of the necessary circuitry elements. If it is desired that electrical braking of the motors be provided after they are turned off, as is the case with spinning machines, for example, two relays can be provided on each motor bar. These relays are built into the control circuit by means of a locking circuit, which, during the "motor braking"brake switch relay condition begun by a turn-off command, prevents a change in this brake switch relay condition by another command, by means of a first timing element the transition from the brake switch relay condition "motor on'-'to the brake switch relay condition "motor braking"is delayed, and by means of a second timing element the transition from the brake switch relay condition "motor braking"to the brake switch relay condition "motor off"is delayed for a predetermined braking period. A particular advantage of this solution is that the direct current required for the braking of the motors can be obtained from the rotary current energy supply system. The motor bars can also carry timing elements which, for example, determine the braking period, delay the transition from motor operation to braking operating, or prevent a signal of a thread monitor from immediately resulting in the associated motor being switched off. In addition, each motor bar can also carry, if desired, necessary logic circuits to prevent, for example, the motor from being turned on during the braking process or when the motor is overheated.

With the foregoing and other objects, advantages and features of the invention that will become hereinafter apparent, the nature of the invention may be more clearly understood by reference to the following detailed description of the invention, the appended claims and to the several views illustrated in the attached drawings.

Figure 8:
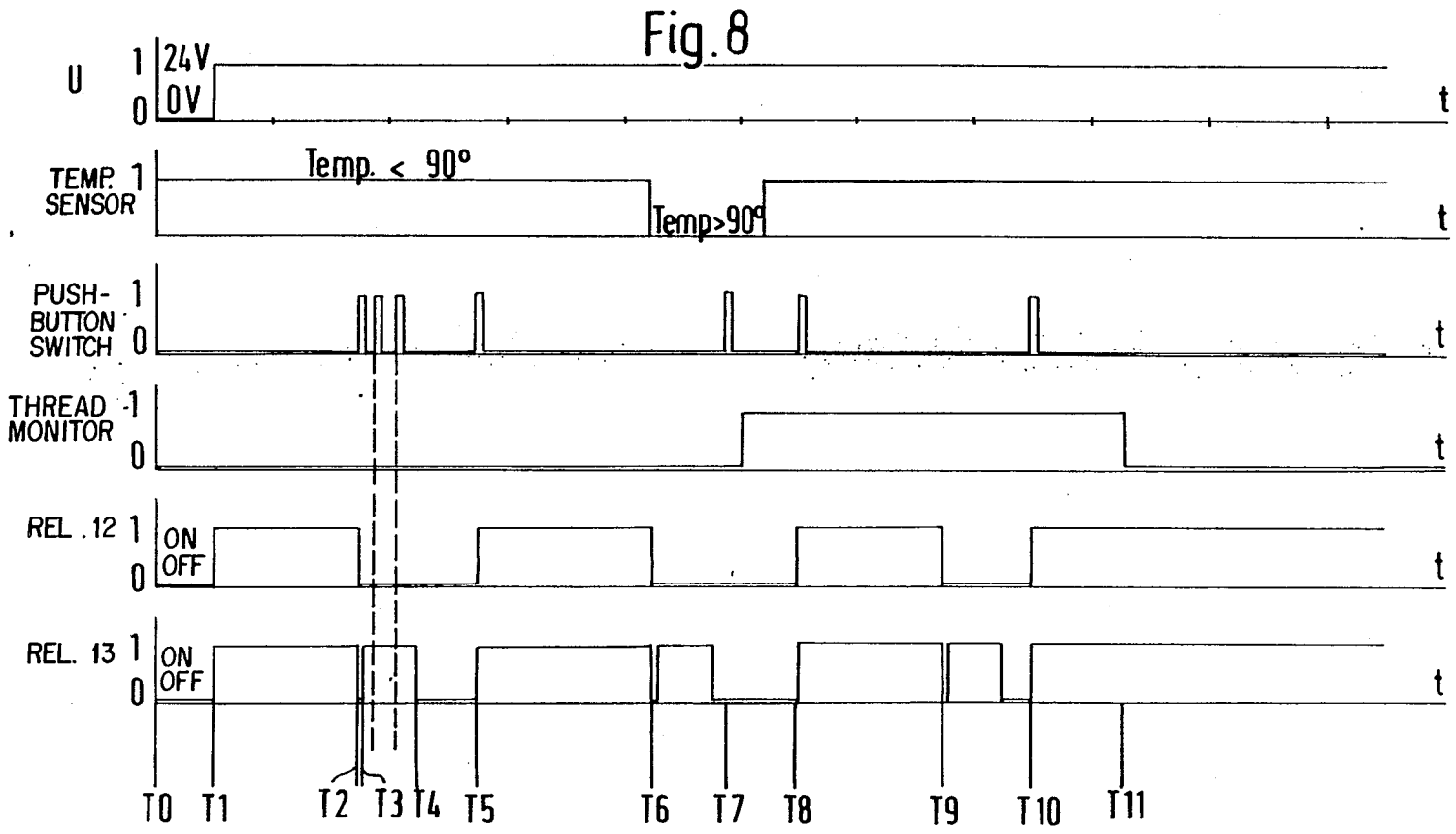
Figure 7D:
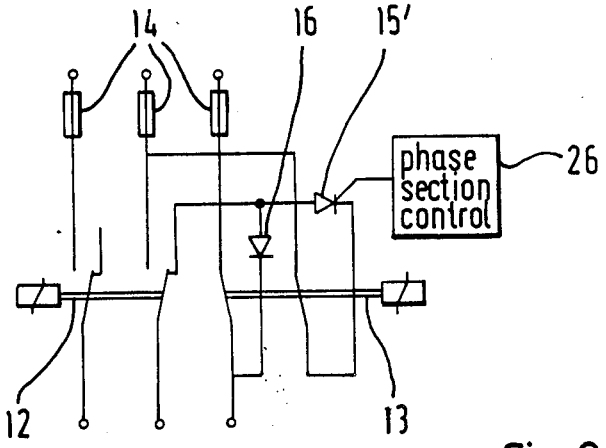

FIGS. *7a* through *7c* show the brake switch relays of each motor bar in their three possible switch positions; while FIG. *7d* shows the substitution of a thyristor and associated phase control circuit for reducing braking current;

FIG. 8 is the signal plan of the motor control; and

Figure 9:
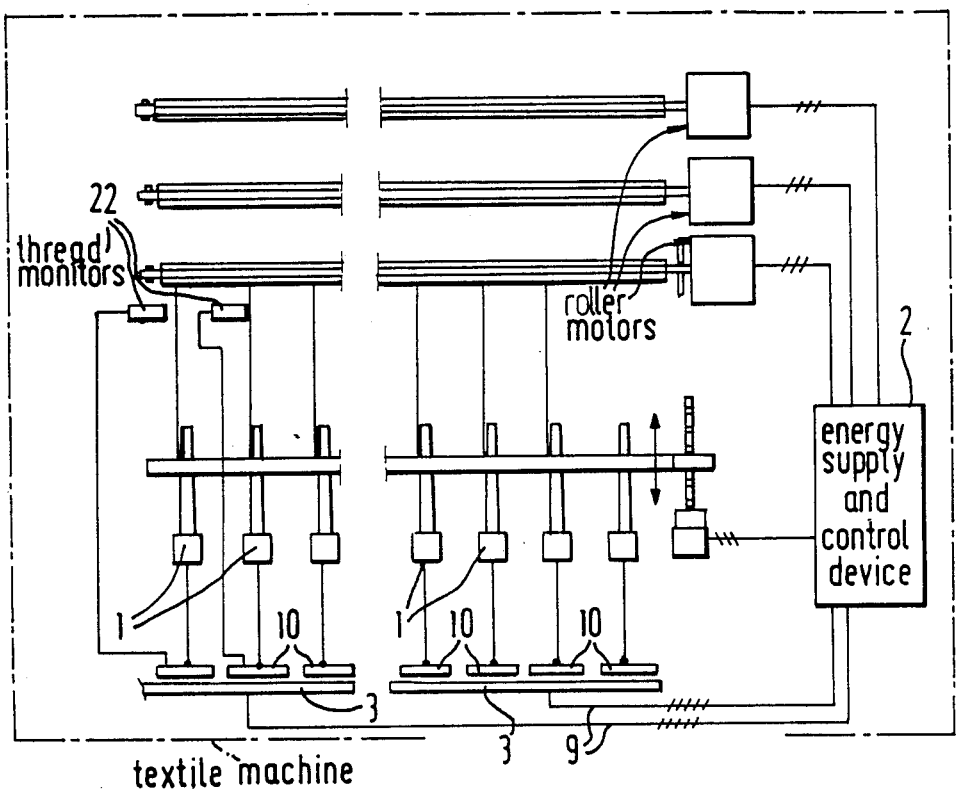

FIG. 9 illustrates a ring spinning or twisting textile machine of the type which is adaptable to the present invention.

DETAILED DESCRIPTION OF A PREFERRED EMBODIMENT

Figure 1:
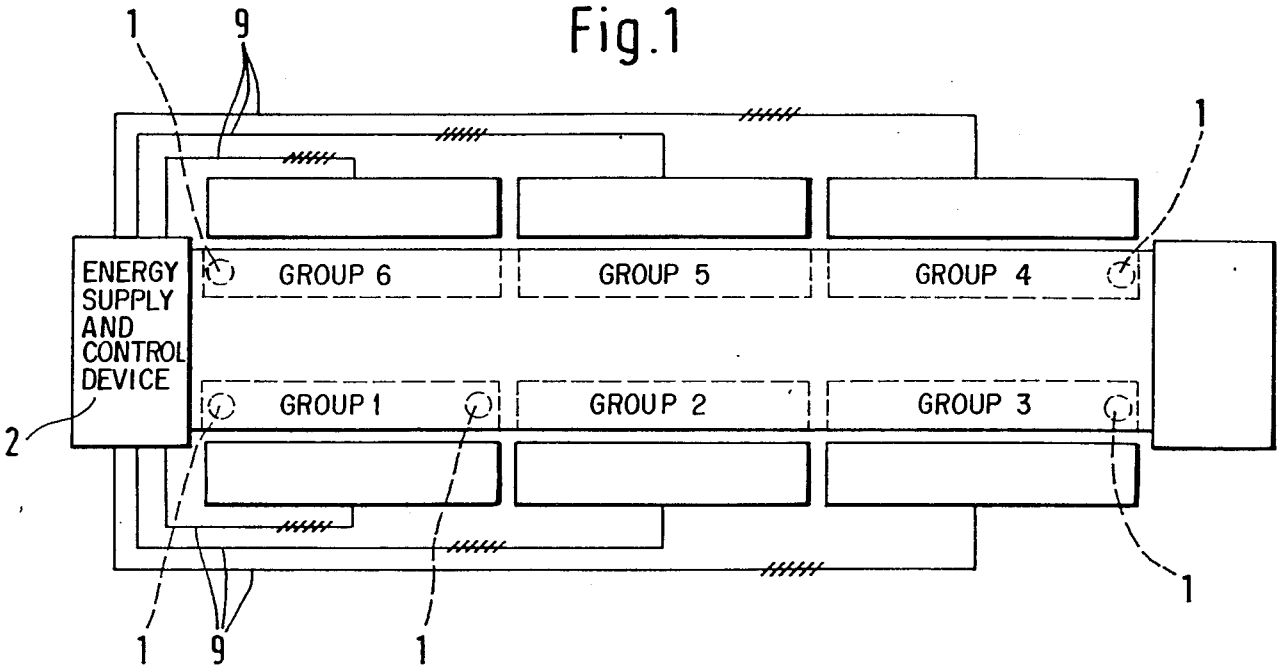
FIG. 1 is a schematically illustrated top view of a spinning machine and the circuit arrangement associated therewith.

Referring now in detail to the drawings wherein like parts are illustrated by like reference numerals throughout, there is schematically illustrated in FIG. 1 a spinning machine having 576 spindles which are arranged adjacent to each other in two rows in the longitudinal direction of the machine on the respective sides of the machine. Each spindle is driven by a rotary current asynchronous motor 1. Only the first and last motors in each row, as well as the last of a first group are schematically illustrated in FIG. 1. The spindles of each row are divided into three respective groups. Because the distribution of the machine, i.e., the width available in the longitudinal direction of the machine for each spindle and the motor 1 that drives it, is 75 mm, each group has a length of 7200 mm. Each group includes 96 spindles with a corresponding number of motors.

An energy supply and control device 2 is provided at one end of the spinning machine, and respective cable conduits (not illustrated) run on both longitudinal sides to the other end of the machine. A row of ground plates 3 extending in the longitudinal direction of the cable conduit and associated with one of the six groups is arranged in each of these cable conduits. In the exemplary embodiment each of these rows consist of three times twelve ground plates 3, all of which are formed identically and have an extended rectangular shape.

Figure 5:
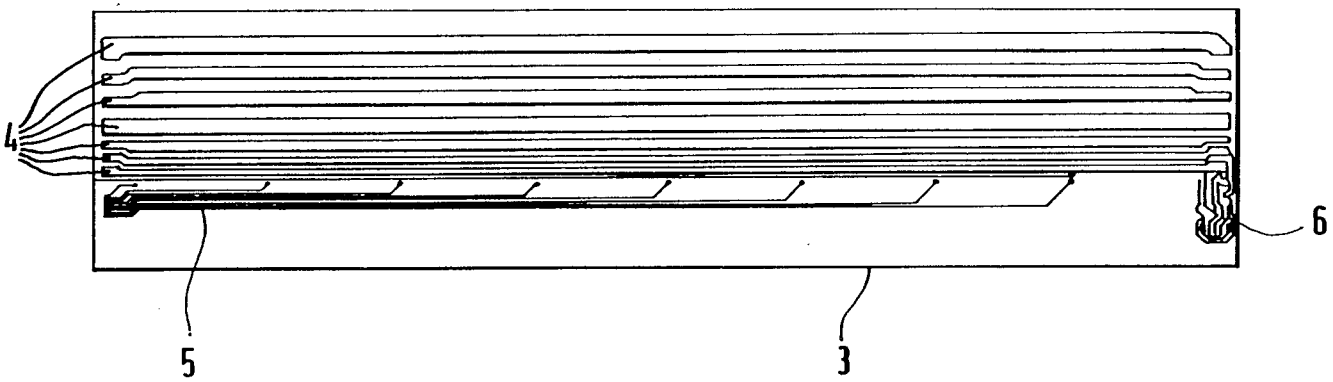
FIG. 5 is a bottom view of the ground plate illustrated in FIG. 4.

The ground plates 3 are formed as bars. As illustrated in FIG. 5, on their undersides they are provided with conductors 4 which extend in straight lines over the entire length of the ground plate 3. Four of these conductors 4 are associated with the three phases of RST and the protective conductor of the energy supply system. Two of these conductors 4 serve to convey the control voltage. Additional conductors 5 extend from one end of the ground plate 3 to one of the equal-sized adjacent eight sections Conductors 6 of an amplifier of a rotary speed probe are provided at the other end of the ground plate 3.

Figure 2:
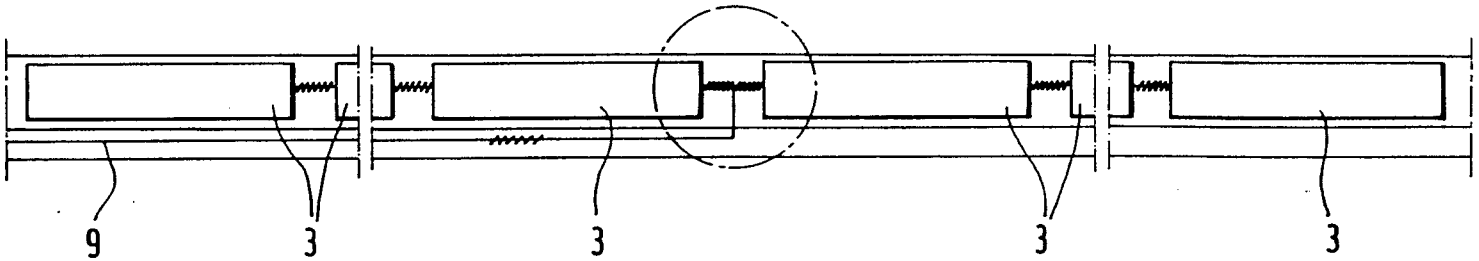
FIG. 2 is a partially illustrated top view of a group of ground plates of the circuit arrangement shown in FIG. 1.
Figure 3:
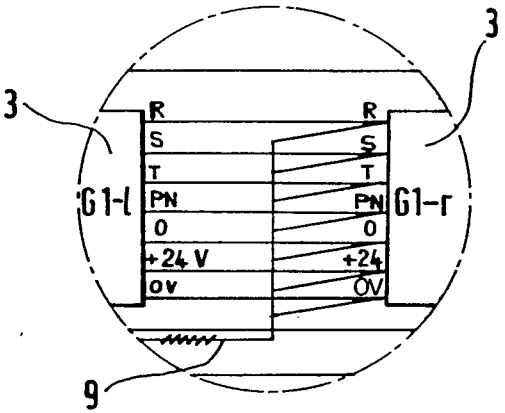
FIG. 3 is an enlarged section A from FIG. 2.
Figure 4:
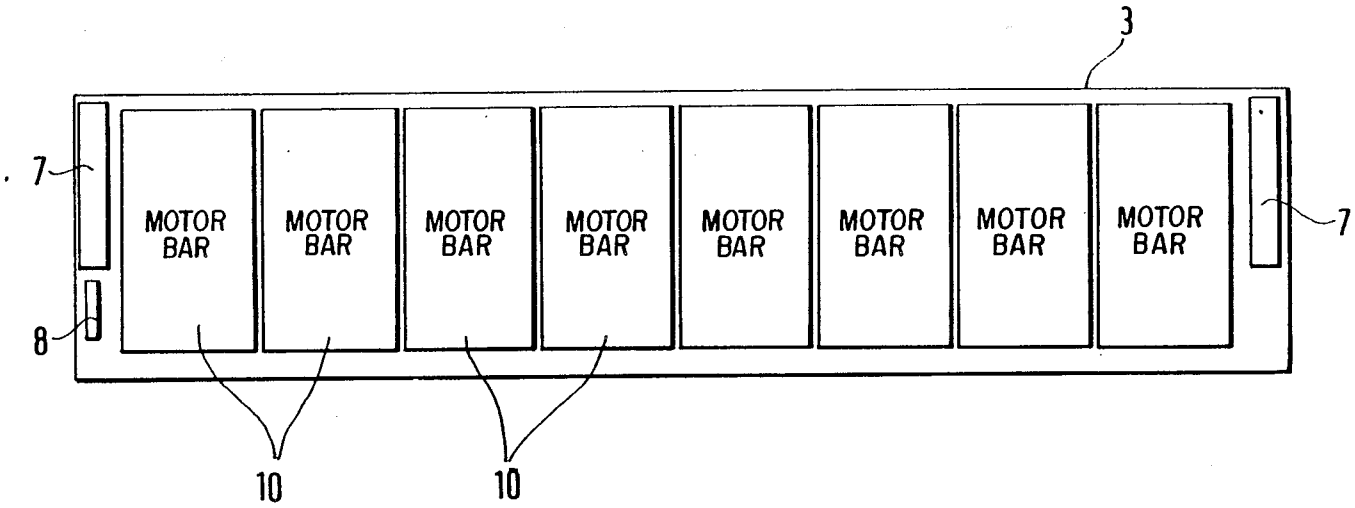
FIG. 4 is a partially illustrated top view of a ground plate illustrated in FIG. 2 having the motor plates arranged thereon.

As shown in FIG. 4, on their upper sides the ground plates 3 carry respective connecting means 7 at each end, and at one end adjacent to said connecting means 7 they carry respective plug connectors 8, the single poles of which are connected with the individual conductors 6. Connecting means 7 may be provided with clamps having a clamping screw and also with plugs or sockets for plugs. The poles of the connecting means 7 are connected with the conductors 4. Flat strap cables (not shown) with plugs produce the connection between the connecting means 7 of adjacent ground plates, as is shown schematically in FIG. 3. In addition, FIGS. 2 and 3 show that in the center of the group. i.e., with twelve ground plates 3 per group between the sixth and seventh ground plates, the ground plates 3 that are connected together to form a group, are connected by the connecting means 7 to a six-line power cable that lies next to the ground plates 3 in the cable conduit and runs to the energy supply and control device 2. Therefore, as also shown in FIG. 1, only three of these power cables 9, which run to the center of the group supplied thereby, lie in each of the two cable conduits.

Eight identically formed motor bars 10 can be arranged adjacent to each other in the longitudinal direction of the ground plate 3 between the two connecting means 7 on the front side of each ground plate 3. Each motor bar 10 is detachably connected with the conductors 4 and 5 by means of plug connections (not shown). Snap closures (also not shown) form a detachable mechanical connection between the ground plate 3 and each of the motor bars 10. Because of the spacing present between the two adjacent ground plates 3 and the space for the connecting means 7, the width of the motor bars 10 measured in the longitudinal direction of the ground plate 3 is somewhat smaller than the division of the machine. In this manner it is assured that each motor bar 10 is at least approximately aligned with the adjoining aggregate.

Aggregates are portions of thread spinning or twisting apparatus, generally including a spindle and a motor for driving the particular spindle.

Each motor bar 10, on its side opposite the ground plate 3, carries a switching control device 11 (FIG. 6), which is connected on one side with the conductor 4 and on the other side with the associated rotary current asynchronous motor 1. This switching control device 11 consists of two double-poled relays 12 and 13, which receive their energizing current from the conductors that carry the control voltage. As shown in FIGS. *7a* through *7c*, the two contact paths of the one relay 12 lie in two of the three conductors leading through respective fuses 14 to the rotary current asynchronous motor 1. The contact path of the relay 13, whose other contact path in the energized condition of the relay places a diode 15 in parallel with the one contact path of the relay 12, if this contact path is open, lies in the third of these conductors. A free-running diode 16 short circuits the two phases when current flows through it during a direct current energization, when the relay 13 interrupts the direct current energization.

As shown in FIG. *7a*, the rotary current asynchronous motor 1 is separated from the converter that supplies it with energy and is arranged in the energy supply and control device 2, when both relays 12 and 13 are not energized. If both relays 12 and 13 are energized, then, as shown in FIG. *7b*, the three phases of the rotary current asynchronous motor 1 are connected with the three corresponding conductors 4. The motor then operates with the rotary speed that is set by the converter. If only the relay 13 is energized, then the rotary current asynchronous motor 1 is braked by means of the direct current passing through the diode 15.

Figure 6:
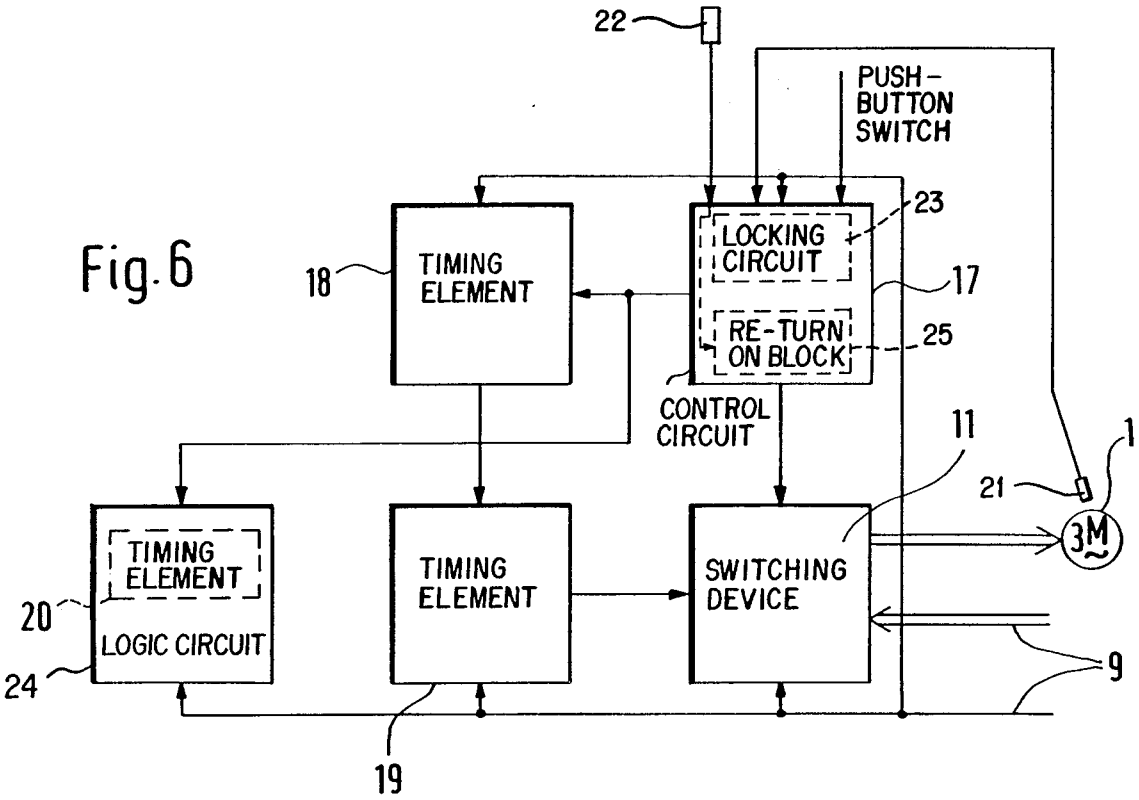
FIG. 6 is a circuit diagram of the circuit arranged on each motor bar.
Figures 7A, 7B, 7C:
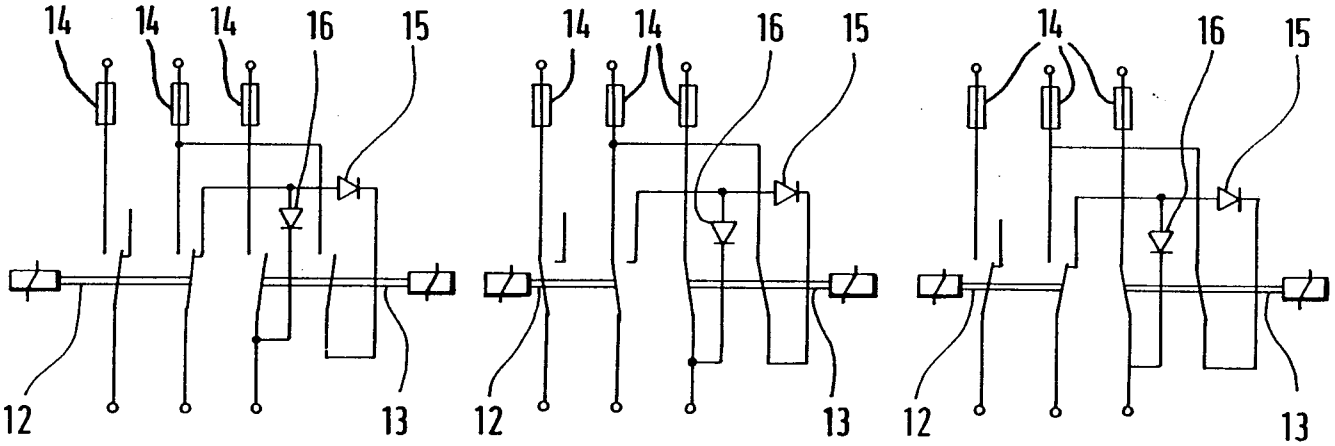

In addition to the switching control device 11, each of the motor bars 10 carries a control circuit 17 and, as shown in FIG. 6, three timing elements 18, 19, and 20. All of these structural groups are supplied with the necessary control voltage by the conductors 4, which control voltage is 24 V in the exemplary embodiment. The locking circuit 23 is a part of the control circuit 17 as shown in FIG. 6. The re-turn on block 25 is another part of control circuit 17; it is connected with the temperature sensor 21. The control circuit 17 is connected both with the switching control device 11 and with the two timing elements 18 and 20, which in the exemplary embodiment have a delay period of 200 ms and 12 s, respectively.

In addition, a manually activated probe (push-button switch), a temperature sensor designated in FIG. 6 by positive temperature coefficient temperature sensor 21 that monitors the motor temperature, and a thread monitor 22 are connected to the control circuit 17. This thread monitor transmits a turn-off command when the thread supplied to the associated aggregate breaks. The timing element 19 is connected behind the timing element 18 and determines the amount of time after which the relay 13 is turned off after the direct current braking. If, as shown in FIG. 8, the machine is started at time point T1, the two relays 12 and 13 are energized. All aggregates are thereby placed into operation. The two relays 12 and 13 are also energized, if they were previously not energized, and a turn-on command is given by the probe. If the probe renews a signal at time point T2, then two relays 12 and 13 are switched off. The relay 13, however, is turned off only for the period of, for example, 200 ms, as determined by the timing element 18. This amount of time is sufficient to dissipate the magnetic energy that is still present in the motor after it is turned off. At the time point T3, which is delayed by the timing element 18 relative to the time point T2, the relay 13 is reenergized, thereby beginning the braking of the rotary current asynchronous motor 1 with direct current. After the braking period of, for example 2.5 s, determined by the timing element 19, the relay 13 is again turned off.

If the direct current supplied by the diode 15 as braking current is too great, then the diode is replaced by a thyristor 15' with an associated phase section control trigger circuit 26. The braking current can then be set to a lower value.

A locking circuit is integrated into the control circuit 17 that prevents an energization of the relay 13, if, during a braking process, a turn-on command is given by the probe. Only after the relay 13 is turned off at the end of a braking process, for example at time point T5, a turn-on command of the probe causes the energization of both relays 12 and 13 and thereby turns on the associated rotary current asynchronous motor 1.

If the motor temperature rises above a predetermined upper limit value, for example above a temperature of 90 degrees C., then the temperature sensor 21 gives a turn-on command to the control circuit 17, by means of which the braking of the motor is started in the above-described manner. The locking circuit prevents the motor from being turned on again, for example by a command from the probe, as long as the turn-off command of the temperature sensor is effective.

A turn-off command given by the thread monitor to the control circuit 17 as a result of a thread break is only effective, due to the timing element 20, if the duration of this signal exceeds the delay time of the timing element 20, which in the exemplary embodiment is 12 s. Therefore, the turn-off signal given by the thread monitor at time point T7 does not prevent the energization of the relays 12 and 13 and thereby the turning on of the rotary current asynchronous motor 1 by a signal from the probe at time point T8, if less than 12 s, lie between T7 and T8. However, if the turn-off signal of the thread monitor is still effective after 12 s beginning from the time point T8 to the time point T9, then the above-described braking and turn-off process takes place. If the motor is again turned on after the braking of the rotary current asynchronous motor 1, for example at time point T10, by a command from the probe, then it remains in operation as long as the turn-off signal from the thread monitor disappears in less than 12 s from the time point T10.

Damage to the circuit components arranged on the motor bars 10 results only in the elimination of a single aggregate and can rapidly be repaired by exchanging the motor bars 10. The ground plates 3 can be exchanged just as rapidly and simple, whereby only the aggregates supplied therefrom are affected. But even if the current supply or control of an entire group is interrupted, all of the remaining groups can continue operating undisturbed.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. For use in textile machine including aggregates having individually driven spindles and individual drive motors associated with said spindles, said aggregates being mounted adjacent to one another to form a row, and a plurality of motor bars forming a row parallel to the row of aggregates, each of said motor bars being spatially and functionally associated with a respective aggregate; the circuit arrangement comprising:

(a) means for supplying energy to said circuit arrangement;

(b) a plurality of elongated ground plates having at least one surface;

(c) a plurality of energy supply conductors on the surface of each ground plate;

(d) a plurality of motor bars arranged in groups on at least two of said elongated ground plates, in which (i) said ground plates extend to form a row of ground plates parallel to the row of motor bars, (ii) said ground plates have a length dimension generally corresponding to the length dimension of the group of motor bars carried thereby and to the associated group of aggregates in the direction of the ground plate row; and (e) means for connecting each successive group of two adjacent ground plates in a row of ground plates to said means for supplying energy.

2. The circuit arrangement according to claim 1, wherein each ground plate has a rear surface, and is provided with signal transfer lines in addition to the energy supply lines on its rear surface opposite the motor bars.

3. The circuit arrangement according to claim 1, wherein each motor bar includes a switching device, said switching device including a control circuit that can be set to the switch condition "motor off", "motor on", and "motor braking".

4. The circuit arrangement according to claim 3, wherein the switching device has first and second double-pole relays whereby the first relay has two switch paths and the second relay has one switch path, which paths lie in the path of a three-phase rotary current system having three conductors, and the second relay has a second switch path including a diode which forms a series circuit which can be placed in parallel with one of the two switch paths of the first relay.

5. The circuit arrangement according to claim 4, wherein the diode is a thyristor having associated therewith a phase section trigger circuit.

6. The circuit arrangement according to claim 3, wherein the control circuit further includes an input for a control voltage which also serves to supply energy, and a plurality of inputs for switch signals produced by at least one manually activated switch and by at least one sensor.

7. The circuit arrangement according to claim 6, in which said textile machines are spinning machines, further including a temperature sensor and a thread monitor, wherein said temperature sensor is connected to a first sensor signal input of the control circuit and said thread monitor is connected to a second sensor signal input of the control circuit.

8. The circuit arrangement according to claim 1, further including a sensor and a signal amplifier, said sensor is connected to said signal amplifier, and wherein at least one of said ground plates and one of said motor bars has at least one additional connector for the sensor connected to the input of the signal amplifier.

9. The circuit arrangement according to claim 3, wherein the control circuit includes a locking circuit, a first timing element, and a second timing element, which during the "motor braking" switch condition begun by a turn-off command, prevents a change in this switch condition by another command, and by means of said first timing element the transition from the switch condition "motor on" to the switch condition "motor braking" is delayed, and by means of said second timing element the transition from the switch condition "motor braking" to the switch condition "motor off" is delayed for a predetermined braking period.

10. The circuit arrangement according to claim 9, further including a thread monitor and a third timing element, wherein the locking circuit includes a logic circuit with said third timing element which only permits switching of the switching device from the switch condition "motor on" to the switch condition "motor braking" on the basis of a turn-off command of the thread monitor when the turn-off command of the thread monitor to the control circuit is continued after the delay period determined by the third timing element.

11. The circuit arrangement according to claim 9, further including a re-turn on block, wherein the control circuit re-turn on block prevents switching of the switching device to the switch condition "motor on" as long as a sensor signal making the re-turn on block effective is supplied to the input of the re-turn on block.

12. The circuit arrangement according to claim 11, further including a sensor, wherein the input of the re-turn on block is connected to said sensor and said sensor has an output signal which gives a turn-off command to the control circuit when a predetermined temperature value is exceeded.

* * * * *